US006858449B2

(12) United States Patent
Hollatz et al.

(10) Patent No.: US 6,858,449 B2
(45) Date of Patent: Feb. 22, 2005

(54) PROCESS AND DEVICE FOR THE ABRASIVE MACHINING OF SURFACES, IN PARTICULAR SEMICONDUCTOR WAFERS

(75) Inventors: Mark Hollatz, Neustadt (DE); Andreas Roemer, Dresden (DE)

(73) Assignee: Infineon Technologies AG, Munich (DE)

( * ) Notice: Subject to any disclaimer, the term of this patent is extended or adjusted under 35 U.S.C. 154(b) by 112 days.

(21) Appl. No.: 10/180,440

(22) Filed: Jun. 26, 2002

(65) Prior Publication Data

US 2002/0197872 A1 Dec. 26, 2002

(30) Foreign Application Priority Data

Jun. 26, 2001 (DE) ..... 101 30 750

(51) Int. Cl.[7] ..... H01L 21/66; H01L 21/302
(52) U.S. Cl. ..... 438/14; 438/692; 438/745
(58) Field of Search ..... 438/14, 692, 745

(56) References Cited

U.S. PATENT DOCUMENTS 5,486,129 A 1/1996 Sandhu et al. ..... 451/5
6,242,352 B1 * 6/2001 Chen et al. ..... 438/691

FOREIGN PATENT DOCUMENTS

WO WO 00/25984 5/2000

* cited by examiner

*Primary Examiner*—Nadine G. Norton
*Assistant Examiner*—Lynette T. Umez-Eronini
(74) *Attorney, Agent, or Firm*—Laurence A. Greenberg; Werner H. Stemer; Ralph E. Locher

(57) ABSTRACT

A process for abrasive machining of surfaces of semiconductor wafers, in particular during the production of electronic memory elements, is described. In the process, a topography of the surfaces of a plurality of wafers is planarized by an at least partially mechanical route. In a further process step which takes place at a later stage, further material is removed from the planarization surfaces by the action of a liquid, chemical composition (etchback). After the planarization step and before the etchback step, a layer thickness measurement of the planarized layer is carried. The method is distinguished by the fact that the measurement results of the layer thickness measurement are used as the basis for the automatic selection or formulation of one of a plurality of chemical compositions and/or the time of action of a selected or formulated chemical composition for carrying out the etchback step.

6 Claims, 1 Drawing Sheet

PROCESS AND DEVICE FOR THE ABRASIVE MACHINING OF SURFACES, IN PARTICULAR SEMICONDUCTOR WAFERS

BACKGROUND OF THE INVENTION

Field of the Invention

The invention relates to a process for the abrasive machining of surfaces on semiconductor wafers, in particular during the production of electronic components, for example of memory elements or the like. In a process step which takes place at an early stage, a topography of the surfaces on a plurality of wafers are planarized by an at least partially mechanical route, and in a process step which takes place at a later stage, further material is removed from the planarized surfaces by being etched back under the action of a liquid, chemical composition. After the planarization step and before the etchback step, the layer thickness of the planarized layer is measured, in particular on individual wafers.

Processes of this type are in widespread use, for example for the production of electronic memory elements. Elements of this type are generally built up in layers containing different materials. Very often, a planarization step has to follow a building or structuring step, which may, for example, contain an etching, sputtering or oxide deposition operation, since the layer structure does not generally satisfy the high-precision surface demands which are required or reproduces the topography of a wiring plane which lies at a lower level, even though it is intended to create a planar surface. Chemical mechanical polishing (CMP) has gained widespread acceptance for performing the planarization.

In CMP, surface regions which lie at a relatively high level are abraded with a high level of accuracy, as far as possible selectively with respect to topography, by interaction of liquid chemicals and abrasive bodies which move on the surface, such as for example polishing grains which can move freely or are fixed in a polishing cloth.

Often, further abrasion is required after the planarization, and the further abrasion is to take place, for example, uniformly over the entire surface. For some applications, material-specific abrasion is also desired, a distinction being drawn between higher regions of a lower-lying layer that have been exposed by the CMP step and the planarized layer which lay at the top. For both forms of further abrasion, the CMP method is unsuitable or at least not very suitable. CMP has a high topography selectivity and is therefore eminently suitable for planarization steps. However, the method is often inefficient for large-area, uniform abrasion of a surface that has already been planarized. For material-specific abrasion it is even unsuitable, since at least the mechanical component of the CMP attacks all the surface materials that have been treated. In both cases, therefore, purely chemical etching steps, known as the etchback process, in which the surface that is to be machined is exposed to a suitable liquid composition of chemicals, are recommended.

In series production of electronic chips in particular, the CMP step is generally carried out batch wise, i.e. with a plurality of wafers being machined simultaneously. This leads to enormous time and therefore cost savings. Corresponding multichamber and multihead installations are increasingly being used. Modern installations are configured in such a way that fluctuations in the abrasion rates between the different heads or chambers are very low. However, the fluctuations, together with those resulting from previous machining steps, such as for example the trench etching or oxide deposition, may cumulatively amount to an order of magnitude which is no longer compatible with the increasingly stringent tolerances required resulting from the fact that the structures on the chips are becoming ever finer.

Therefore, there is widespread use of installations in which, in a region that performs CMP, a measuring configuration is provided, which is used to determine the fluctuations within a batch by measuring the layer thickness of each individual wafer. The measurement results are used as a quality criterion for reaching a decision on whether it is necessary to remachine or possibly even scrap the batch or individual wafers. However, as the tolerances decrease, scrap rises to an economically unacceptable degree.

SUMMARY OF THE INVENTION

It is accordingly an object of the invention to provide a process and a device for the abrasive machining of surfaces that overcome the above-mentioned disadvantages of the prior art methods and devices of this general type, which has a is scrap rate that is greatly reduced.

With the foregoing and other objects in view there is provided, in accordance with the invention, a process for abrasive machining of surfaces of semiconductor wafers. The process includes planarizing a topography of the surfaces of the semiconductor wafers using at least a partially mechanical process resulting in planarized surfaces, measuring a layer thickness of the planarized surfaces, and using measurement results of the measuring of the layer thickness as a basis for formulating parameters for determining an automatic selection of one of a plurality of liquid chemical compositions and/or a time of action of a selected chemical composition for carrying out an etch-back process. Further material is removed from the planarized surfaces by etching back under an action of the selected chemical composition the planarized surfaces.

In detail, the measures have the following significance. The measured values from the layer thickness measurement are no longer used only for quality assurance, but rather are also used as active control parameters in the further process. In particular, they are used as the basis for automatic selection or setting of further machining parameters in the subsequent etchback step. Suitable parameters are in particular the machining time and/or the composition of the treatment liquid.

This makes it possible to accurately compensate for fluctuations within the batch by targeted remachining. Since the compensation takes place together with a machining step that is carried out in any case, there is also no time delay. The etchback step is recommended as being particularly is favorable for compensating for fluctuations in accordance with the invention since the interaction between the chemicals which are customarily used and the material which is to be abraded, as well as the effect of different machining times in the machining step, are very well known.

In accordance with an added mode of the invention, there is the step of taking the parameters used in the etch-back process from a table stored in a data-processing unit. Alternatively, the parameters are calculated for the etch-back process on a basis of functions that are stored in a data-processing unit.

In accordance with a further mode of the invention, the semiconductor wafers are used in the production of electronic components, in particular for producing memory elements.

In accordance with another mode of the invention, the selected chemical composition is formulated from the parameters.

A further object of the invention is to provide a device that is suitable in particular for carrying out the process according to the invention.

These features in detail have the now described significances. The device according to the invention has at least two regions of which one is suitable for carrying out a known CMP machining step. A further region of the device according to the invention is configured suitably for carrying out a known etchback step. A measuring configuration for measuring the layer thickness of the top layer of the wafer is provided, preferably in the first region of the device. According to the invention, there is a connection between the measuring configuration and the second region of the device, in which the etchback step is performed, such that the measurement results of the layer thickness measurement can he transmitted as information to the etchback region of the device, where they automatically initiate the selection or setting of process parameters which are used to carry out the etchback step on the wafer on which the corresponding measurement has been carried out.

The coupling of the two regions, which may contain in particular a data line belonging to two individual machines or software linking of what is known as a cluster installation, i.e. an installation in which the two device regions are integrated in a single machine, allows each wafer to be etched back in an individually optimized manner. This in particular allows automatic setting or selection of parameters, which on the one hand rules out human errors in setting and on the other hand ensures a particularly reliable process sequence.

In accordance with an added feature of the invention, a data-processing unit storing process parameters that are dependent on a result of the layer thickness measurement is provided, and the data-process unit is coupled to the measuring configuration.

In accordance with an additional feature of the invention, a data-processing unit for calculating process parameters that are dependent on a result of the layer thickness measurement is provided, the data-process unit is coupled to the measuring configuration.

In accordance with a further feature of the invention, the second device region has a control device connected to the measuring configuration and to the data-processing unit by a data line.

In accordance with another feature of the invention, the control device is part of the data-processing unit and is linked by software to the measuring configuration.

In accordance with a concomitant feature of the invention, the second region has a cleaning device for cleaning the semiconductor wafers.

Other features which are considered as characteristic for the invention are set forth in the appended claims.

Although the invention is illustrated and described herein as embodied in a process and a device for the abrasive machining of surfaces, in particular semiconductor wafers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

DESCRIPTION OF THE PREFERRED EMBODIMENTS

Figures 1A, 1B, 2A, 2B, 3:
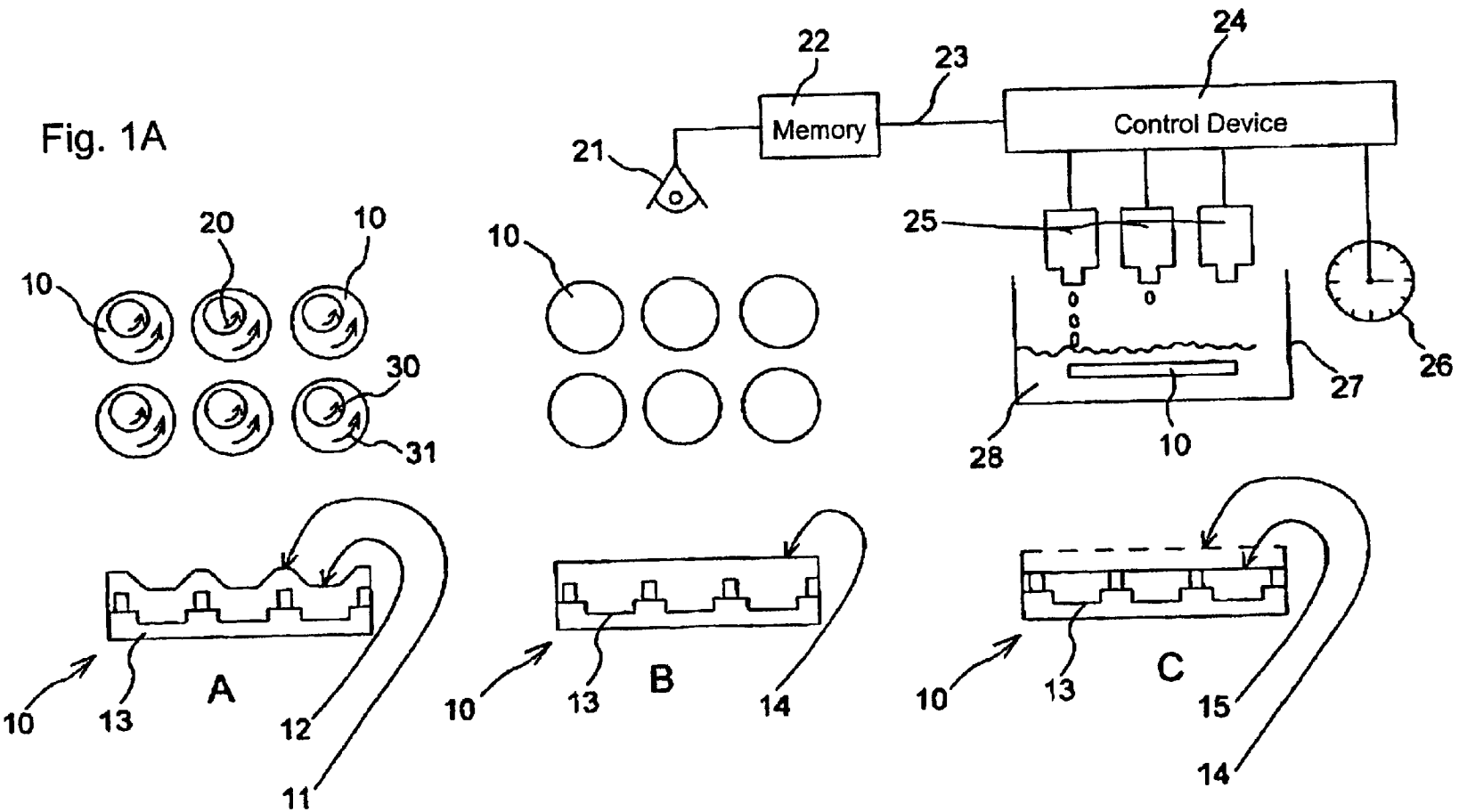
FIG. 1A is a diagrammatic, plan view of a plurality of wafers under going a process according to the invention.
FIG. 1B is a diagrammatic, sectional view of a wafer that has not been planarized.
FIG. 2A is an illustration of process equipment.
FIG. 2B is a diagrammatic, sectional view of the wafer after planarization.
FIG. 3 is a diagrammatic, sectional view of the after a further process step.

Referring now to the figures of the drawing in detail and first, particularly, to FIGS. 1A to 3 thereof, there is shown a particularly advantageous embodiment of a process according to the invention. FIGS. 1A and 2A show the individual process steps, while FIGS. 1B, 2B and 3 illustrate the effect which these steps have on a wafer 10.

In an early process step A, which is referred to below as the first process step, even though in the overall production sequence of the chips it is preceded by a range of further steps, a plurality of wafers 10 together are subjected to CMP planarization. Each of the wafers 10 can be positioned on a rotating plate and brought into surface contact with a polishing pad 20, which likewise rotates (FIG. 1A). A liquid (slurry) that contains free polishing grains and is preferably basic is added. The polishing plate and the polishing pad 20 preferably rotate at different speeds in the same direction of rotation, indicated by movement arrows 30 and 31. Naturally, it is also possible for the elements to carry out other movements or for only one element to be moved. As an alternative to the slurry, it is also possible to use polishing cloths that contain polishing grains and, by way of example, can be pulled onto the pads.

FIG. 1B diagrammatically depicts the wafer 10 before the planarizing step is applied. The still pronounced topography of the surface, with elevated regions 11 and valleys 12, is clearly visible. These are formed, for example, as a result of oxide deposition on a structured wiring plane 13 that lies at a lower level.

After the polishing step has concluded, the wafer 10 has the form illustrated in FIG. 2B. The topography has been planarized and the wafer 10 has a planar surface 14. In this state, a layer thickness measurement B, performed by a measuring configuration 21, is to be carried out. The measurement is preferably carried out in a region of the device where the CMP is carried out. This has the advantage that at that point the wafers 10 are in batches, precisely oriented and in a wet state, which is advantageous for the measurement. The measured values recorded by the measuring configuration 21 are stored in a buffer memory 22. The buffer memory 22 is connected via a data line 23 to a control device 24 that, for example, controls chemicals tanks 25 and/or an automatic timing unit 26. The control device 24 controls a chemical composition 28 which is used to treat the wafer 10 in an etchback vessel 27, a treatment time used to achieve the etchback result, a temperature and/or if appropriate further parameters, are optimized on the basis of the measured layer thickness. The effect on the wafer 10 is indicated in FIG. 3. The original surface 14 of the wafer 10 is abraded to a new surface 15, which corresponds to a desired layer thickness.

In the exemplary embodiment illustrated, the new surface 15 is likewise planar. However, it is also possible, for example, to create the surface 15 with a new, non-planar topography by material-specific etchback.

It is recommended for the optimum chemical composition formulations and/or treatment times to be stored in tables and to be called up according to the measurement result achieved. Of course, it is also possible for the parameters that are to be set to be calculated for each individual case, provided that analytical functions that are suitable for this purpose are known.

In the exemplary embodiment shown, the regions for the polishing step A and the etchback step C are spatially separate from one another and are connected by the data line 23. However, it is also possible, when using a cluster installation, to replace the data line 23 by a simple software link.

The measuring configuration 21, which in the exemplary embodiment illustrated is disposed in the CMP region of the installation, may, however, be provided in a different region of the device. The second region, in which the etchback step C is carried out on the individual wafers 10, would be possible. However, this can lead to delays, since the measurement and the inventive setting of the process parameters can only take place after the wafer 10 has been positioned in the region. Of course, it is also possible to provide a dedicated, spatially separate measuring station.

Particularly in the case of CMP steps that operate using the slurry method, cleaning of the wafers 10 is then required. This removes polishing grains adhering to the surface and abraded, fine-grained material from the planarized surface 14. The cleaning often takes place with brush cleaners. If chemically stable vessels are used for this purpose, the etchback step C can likewise be carried out in these vessels.

Of course, the described embodiments of the process according to the invention are merely examples that illustrate the invention without restricting it.

We claim:

1. A process for abrasive machining of surfaces of semiconductor wafers, which comprises the steps of:

planarizing a topography of the surfaces of the semiconductor wafers using at least a partially mechanical process resulting in planarized surfaces;

measuring a layer thickness of the planarized surfaces;

using measurement results of the measuring of the layer thickness as a basis for formulating parameters for determining an automatic selection of one of a plurality of liquid chemical compositions, a treatment time to achieve an etch-back result using a selected liquid chemical composition and/or a treatment temperature of the selected liquid chemical composition for carrying out an etch-back process; and removing further material from the planarized surfaces by etching back under an action of the selected chemical composition the planarized surfaces.

2. The process according to claim 1, which comprises taking the parameters used in the etch-back process from a table stored in a data-processing unit.

3. The process according to claim 1, which comprises calculating the parameters used as the basis for the etch-back process on a basis of functions that are stored in a data-processing unit.

4. The process according to claim 1, which comprises using the semiconductor wafers in a production of electronic components.

5. The process according to claim 1, which comprises using the semiconductor wafers in a production of memory elements.

6. The process according to claim 1, which comprises formulating the selected liquid chemical composition.

* * * * *